US007150379B2

(12) United States Patent
Lee

(10) Patent No.: US 7,150,379 B2
(45) Date of Patent: Dec. 19, 2006

(54) DYEING BRUSH

(76) Inventor: Youth Lee, 13F, No. 232, Sec. 3, Ba-De Road, Taipei (TW)

( * ) Notice: Subject to any disclaimer, the term of this patent is extended or adjusted under 35 U.S.C. 154(b) by 409 days.

(21) Appl. No.: 10/872,935

(22) Filed: Jun. 19, 2004

(65) Prior Publication Data

US 2005/0279375 A1 Dec. 22, 2005

(51) Int. Cl.
*G01F 11/00* (2006.01)
*B67D 5/22* (2006.01)

(52) U.S. Cl. ..... 222/390; 222/46; 401/174

(58) Field of Classification Search ..... 222/390, 222/46; 401/174; 132/112–116
See application file for complete search history.

(56) References Cited

U.S. PATENT DOCUMENTS 1,252,719 A * 1/1918 Proctor ..... 401/174
1,340,043 A * 5/1920 Grace ..... 222/390
2,163,974 A * 6/1939 Blett ..... 222/46
2,249,991 A * 7/1941 Trutneff ..... 132/114
2,272,641 A * 2/1942 Mureau ..... 401/288
2,728,097 A * 12/1955 Seifert ..... 401/175
5,538,161 A * 7/1996 Koehler et al. ..... 222/46
6,009,886 A * 1/2000 Labranche et al. ..... 132/309
6,022,163 A * 2/2000 Asfur ..... 401/175

* cited by examiner

*Primary Examiner*—Gregory L. Huson

(57) ABSTRACT

A dyeing brush includes a handle having a first blind hole defined in the neck and a second blind hole defined to communicate with the firs blind hole. A knob is rotatably received in the first blind hole and has a threaded hole defined through the knob to communicate with the second blind hole of the handle. A hollow tube has an attachment fixedly attached to a side face of the tube and having teeth extending out from a side face of the attachment. A threaded bolt is rotatably and movably received in the tube to correspond to and threadingly extend through the knob. A cover is to close the upper opening of the tube and has an extension to be received in the cutout of the tube.

5 Claims, 5 Drawing Sheets

DYEING BRUSH

BACKGROUND OF THE INVENTION

1. Field of the Invention

The present invention relates to a dyeing brush, and more particularly to a dyeing brush to enable the operator to easily and evenly dye the hair without contamination to the fingers.

2. Description of Related Art

In beauty salons, the beautician uses a container to receive therein hair dye and then puts on a pair of gloves when a brush is used to brush the hair dye onto the hair. With the method just described, the operator often contaminates the fingers with the hair dye. Besides, the hair is not evenly dyed. In order to obviate the aforementioned problem, a conventional dyeing brush is introduced to the market. With reference to FIG. 5, the conventional dyeing brush has a tube (10*a*) with a base (11*a*) movably received in the tube (10*a*) and a threaded bolt (12*a*) rotatably received in the tube (10*a*) and threadingly connected to and extending through the base (11*a*). The threaded bolt (12*a*) has a knob (13*a*) securely and fixedly connected to a distal end of the threaded bolt (12*a*) to control the rotatable movement of the threaded bolt (12*a*) such that when hair dye is received in the tube (10*a*), rotation of the knob (13*a*) is able to gradually move the hair dye out of the tube (10*a*) by the upward movement of the base (11*a*).

Even though the conventional dyeing brush is able to prevent the contamination of the operator's hands, because the engagement between the threaded bolt (12*a*) and the tube (10*a*) is not perfectly sealed, the hair dye will flow out of the tube (10*a*) to contaminate the environment.

Other objects, advantages and novel features of the invention will become more apparent from the following detailed description when taken in conjunction with the accompanying drawings

SUMMARY OF THE INVENTION

The primary objective of the present invention is to provide an improved dyeing brush to easily brush hair dye onto the hair without contaminating the operator's hands.

Other objects, advantages, and novel features of the invention will become more apparent from the following detailed description when taken in conjunction with the accompanying drawings.

DETAILED DESCRIPTION OF PREFERRED EMBODIMENT

Figure 1:
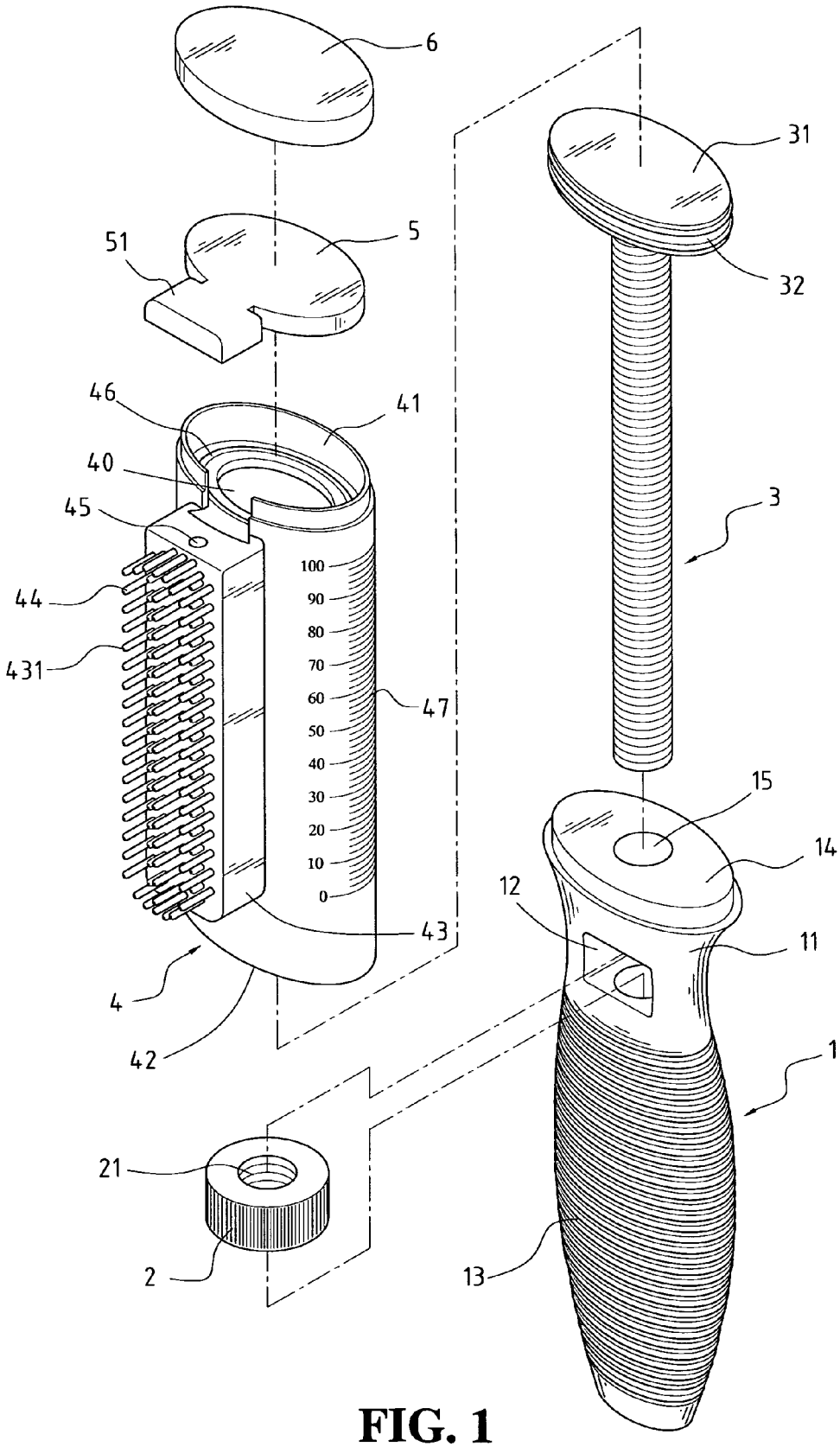
FIG. 1 is a an exploded view of a dyeing brush constructed in accordance with the present invention.

With reference to FIG. 1, a dyeing brush of the present invention includes a handle 1, a knob 2, a threaded bolt 3, a tube 4, a cover 5 and a cap 6. The handle 1 has a neck 11 formed on a top portion of the handle 1, a first blind hole 12 defined in the neck 11, a pattern 13 formed on an outer periphery of the handle 1, an oval flange 14 formed on a distal end of the handle 1 and a second blind hole 15 defined to communicate with the first blind hole 12.

The knob 2 has a threaded hole 21 defined through the knob 2. The threaded bolt 3 has an oval base 31 and a first seal 32 provided on a peripheral side of the oval base 31. The tube 4 is hollow and has an upper opening 41 and a lower opening 42 in communication with the upper opening 41. A cutout 40 is defined in a side face defining the upper opening 41. An attachment 43 is fixedly attached to a side face of the tube 4 and has teeth 44 extending out from a side face of the attachment 43, at least one hole 45 defined in a side face of the attachment 43 to communicate with multiple outputs 431 defined in the side face where the teeth 44 is formed. A second seal 46 is securely located on a side face defining the upper opening 41 and an index 47 is formed on the outer periphery of the tube 4. The cover 5 has an extension 51 extending from a peripheral side face of the cover 5 to correspond to the cutout 40 of the tube 4.

Figure 2:
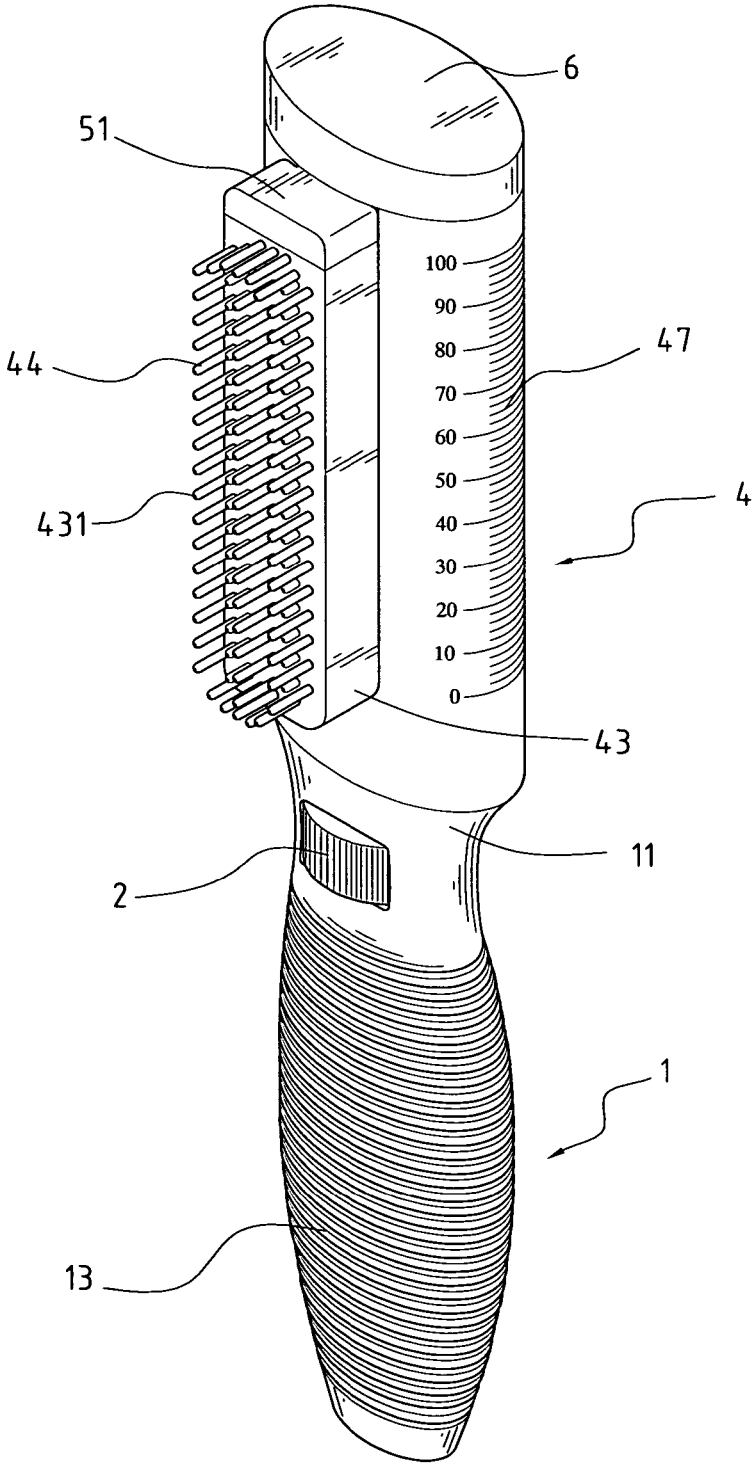
FIG. 2 is a perspective view of the dyeing brush of the present invention.
Figure 3:
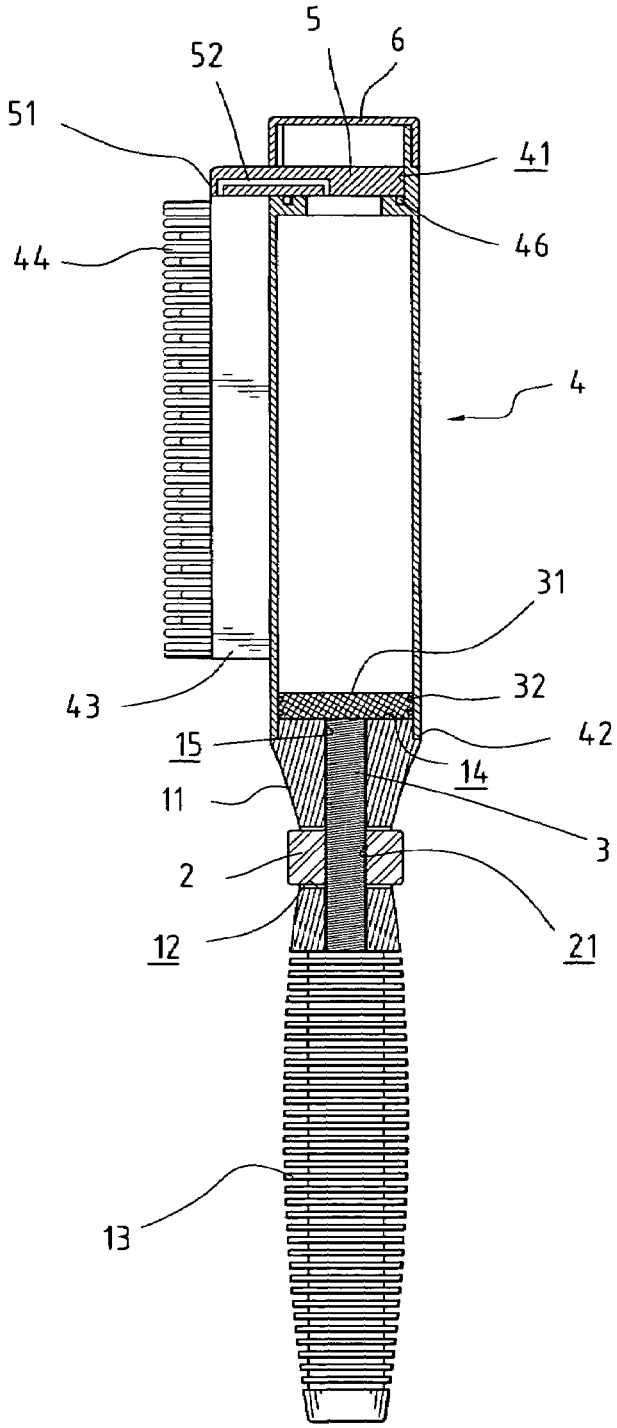
FIG. 3 is a schematic cross-sectional view showing inner structure of the dyeing brush of the present invention.

When the dyeing brush of the present invention is assembled, it is noted in FIGS. 2 and 3 that the knob 2 is received in the first blind hole 12 and then a free end of the threaded bolt 3 is extended into the second blind hole 15 and through the threaded hole 21 of the knob 2 to allow engagement between the oval base 31 and the oval flange 14. The oval flange 14 together with the oval base 31 is extended into the tube 4 via the lower opening 42 to allow the engagement between the side face defining the lower opening 42 and the oval base 31 to be watertight. Then the cover 5 is placed on top of the upper opening 41 to close the upper opening 41 with the extension 51 received in the cutout 40. It is noted that due to the second seal 46 in the upper opening 41, the engagement between the cover 5 and the side face defining the upper opening 41 is watertight.

Figure 4:
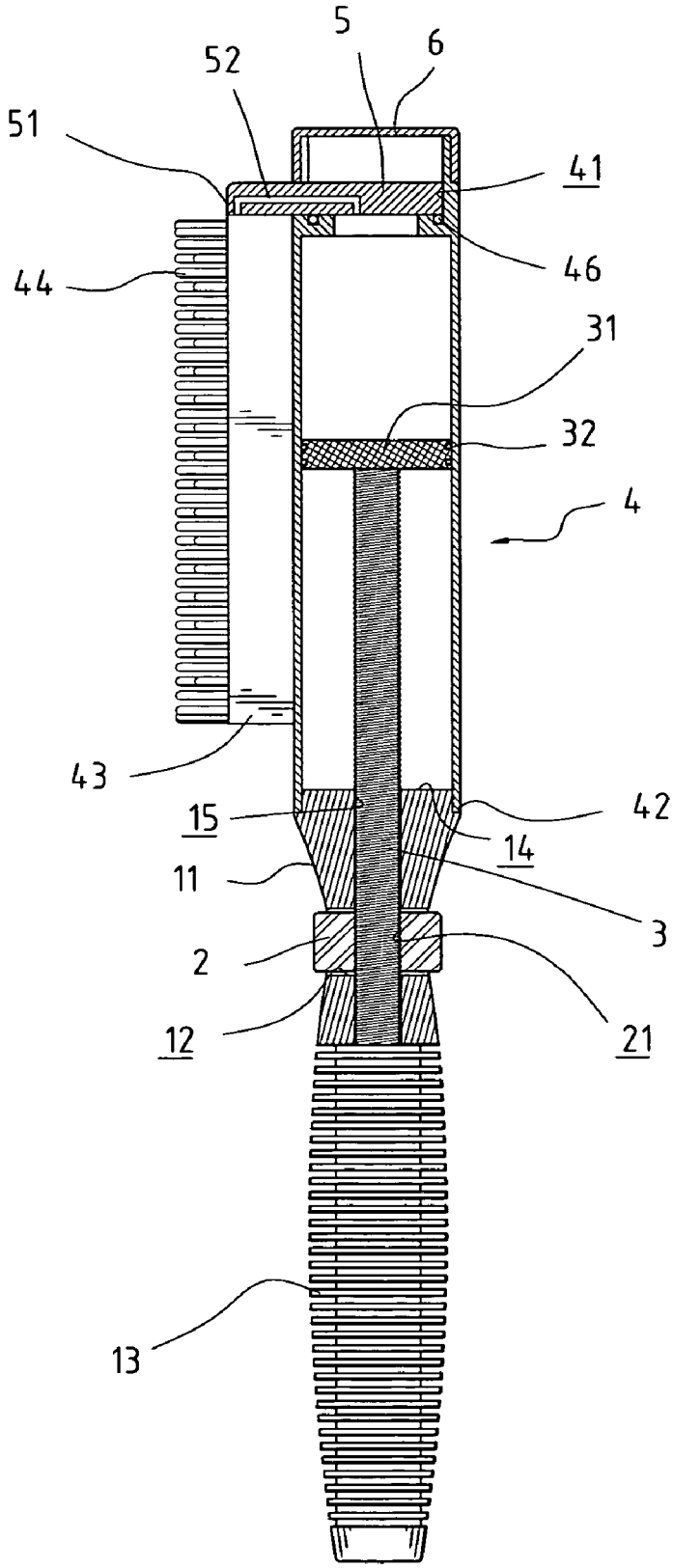
FIG. 4 is a schematic view showing movement of a threaded bolt to push the hair dye upward so as to move into the receiving room of the tube.
Figure 5:
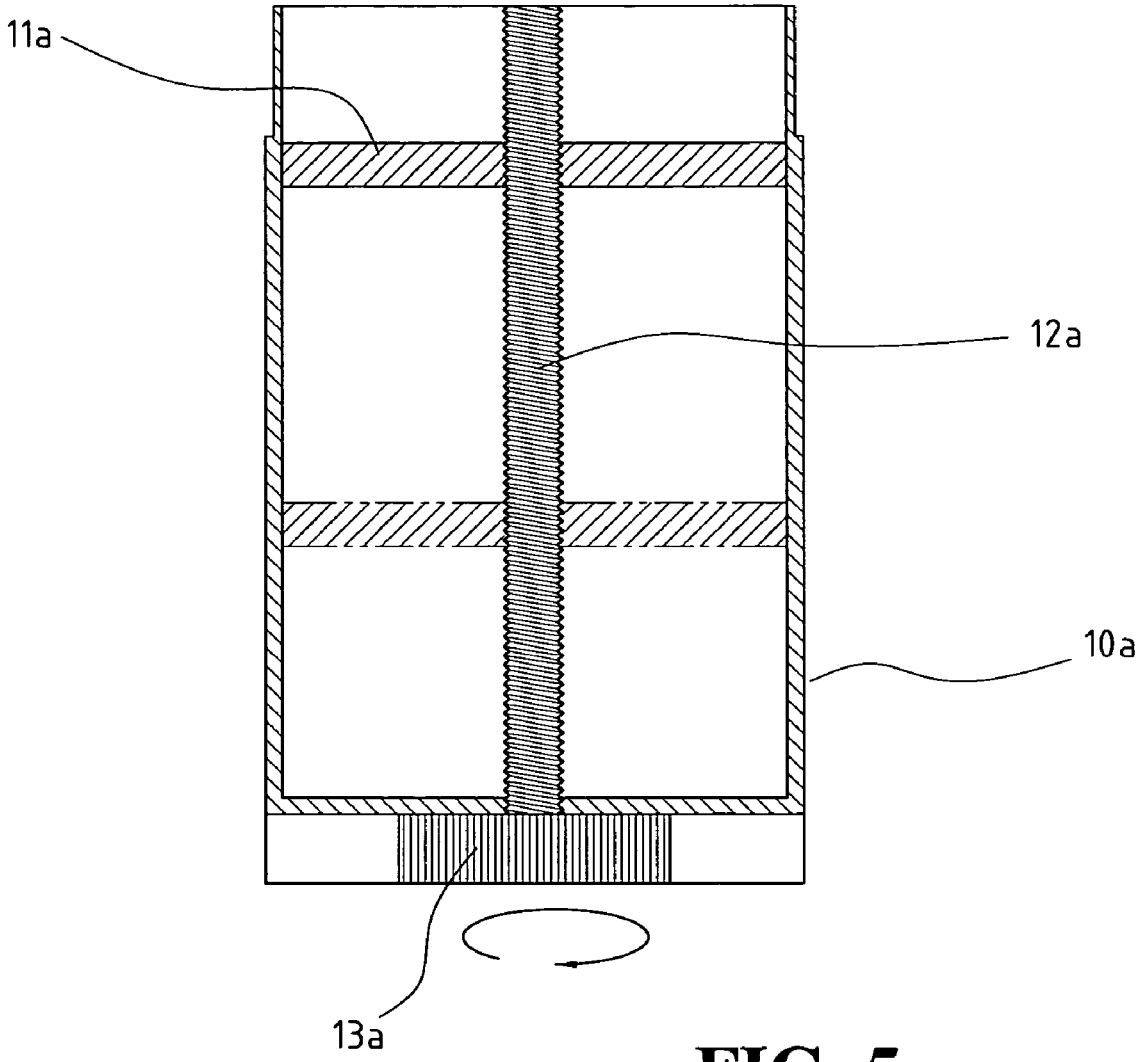
FIG. 5 is a schematic view showing a portion of the conventional dyeing brush.

After the cover 5 is placed on top of the upper opening 41, a passage 52 that is defined in the cover 5 and in communication with the upper opening 41 is in communication with the hole 45. Thereafter, the cap 6 is securely and removably received in the upper opening 41 to complete the assembly of the dyeing brush of the present invention. With reference to FIGS. 3 and 4, after the tube 4 is filled with dye from the upper opening 41, the cover 5 is placed on top of the upper opening 41 to close the upper opening 41 and to allow the communication between the passage 52 and the hole 45. In the meantime the dye is received between the cover 5 and the oval base 31. Furthermore, due to the first seal 32 and second seal 46, the dye is securely received between the oval base 31 and the cover 5 without leakage. Therefore, the rotation of the knob 2 is able to push the threaded bolt 3 to move upward relative to the tube 4 so that the dye in the tube 4 is pushed by the oval base 31 to flow through the passage 52, the hole 45 and into the outlets 431 in the attachment 43. With the brushing movement of the dyeing brush of the present invention, the dye is evenly distributed. Furthermore, the operator needs not worry the contamination of hands.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dyeing brush comprising:

a handle having a neck formed on a top portion of the handle, a first blind hole defined in the neck, a pattern formed on an outer periphery of the handle, an oval flange formed on a distal end of the handle and a second blind hole defined to communicate with the first blind hole;

a knob rotatably received in the first blind hole and having a threaded hole defined through the knob to communicate with the second blind hole of the handle;

a hollow tube having an upper opening, a lower opening in communication with the upper opening, a cutout defined in a side face defining the upper opening, an attachment fixedly attached to a side face of the tube and having teeth extending out from a side face of the attachment, a hole defined in a side face of the attachment to communicate with multiple outputs defined in the side face where the teeth is formed and an index formed on an outer periphery of the tube;

a threaded bolt rotatably and movably received in the tube to correspond to and threadingly extend through the knob, the threaded bolt having an oval base formed on a distal end of the threaded bolt to be selectively received in the upper opening and a first seal provided on a peripheral side of the oval base; and a cover having an extension extending from a peripheral side face of the cover to correspond to and received in the cutout of the tube.

2. The dyeing brush as claimed in claim 1, wherein a first seal is mounted around a peripheral side face of the oval base to allow an engagement between the oval base and an inner side wall of the tube to be watertight.

3. The dyeing brush as claimed in claim 1, wherein a second seal is mounted around a side face defining the upper opening to allow an engagement between the cover and the tube to be watertight.

4. The dyeing brush as claimed in claim 2, wherein a second seal is mounted around a side face defining the upper opening to allow an engagement between the cover and the tube to be watertight.

5. The dyeing brush as claimed in claim 4, wherein the cover has a passage defined in the cover to communicate with the upper opening of the tube and the hole of the attachment.

* * * * *